United States Patent [19]

Pringle et al.

[11] Patent Number: 4,686,612

[45] Date of Patent: Aug. 11, 1987

[54] LAMP REFLECTOR ASSEMBLY

[75] Inventors: David A. Pringle, Pacific Palisades; Helen Gourley, San Francisco, both of Calif.

[73] Assignee: Optech Inc., Burbank, Calif.

[21] Appl. No.: 791,214

[22] Filed: Oct. 25, 1985

[51] Int. Cl.[4] ..... F21V 7/04

[52] U.S. Cl. ..... 362/297; 362/346; 362/350

[58] Field of Search ..... 362/297, 299, 301, 346, 362/349, 350, 373, 294, 345

[56] References Cited

U.S. PATENT DOCUMENTS 1,711,478 4/1929 Halvorson, Jr. ..... 362/350

3,359,415 12/1967 Lasker ..... 362/349

4,231,080 10/1980 Compton ..... 362/346

*Primary Examiner*—Larry I. Schwartz

[57] ABSTRACT

A reflector assembly for projecting a beam of light along an optical axis, the assembly including an enclosure having an aperture for projecting the beam of light and a source of light mounted within the enclosure. A reflecting mirror is disposed within the enclosure and arranged to move axially with respect to the optical axis of the beam of light between positions adjacent the aperture and remote from the aperture. A plurality of reflector segments are disposed between the movable reflector and the aperture in the enclosure, the segments each being defined as a portion of a cone or cylinder and with gaps therebetween arranged so as to permit the passage of air between the segments.

18 Claims, 11 Drawing Figures

FIG. 1
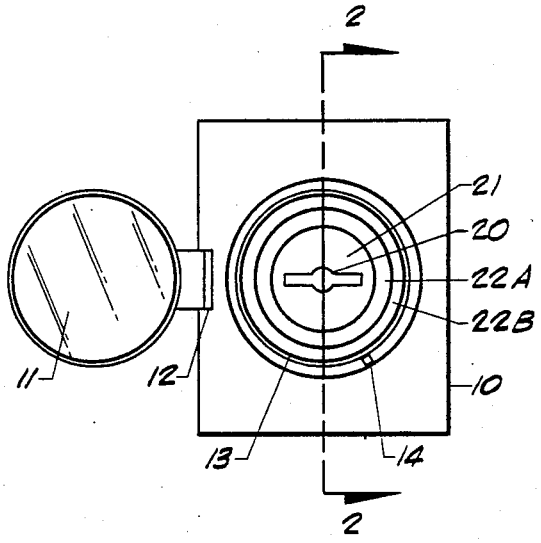
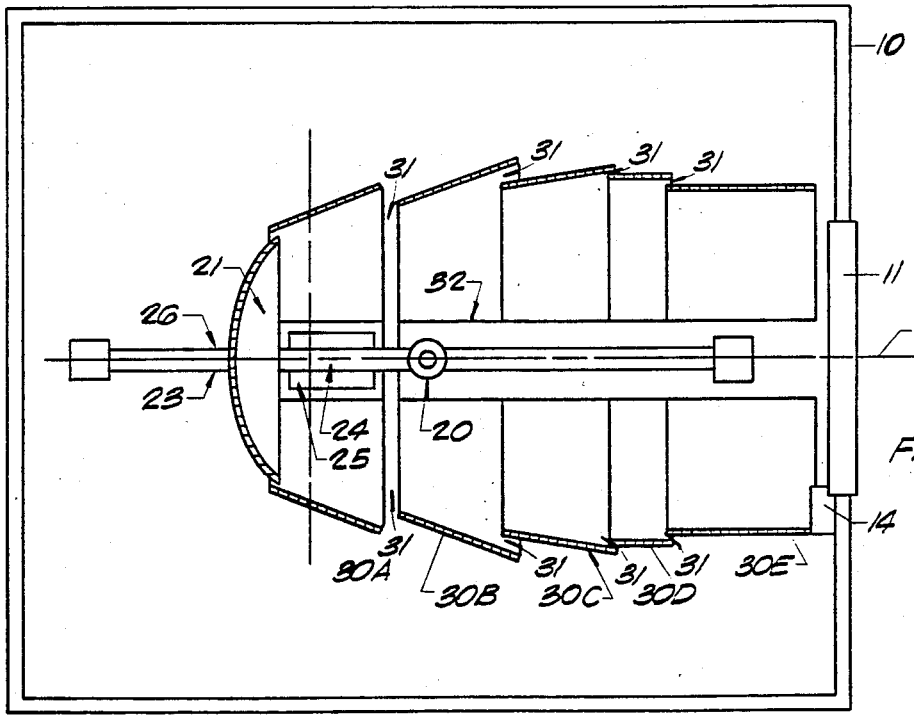
FIG. 2

LAMP REFLECTOR ASSEMBLY

TECHNICAL FIELD

This invention relates to lamp reflectors and more particularly to reflectors of the type which may be conveniently used with high energy lamps. Such lamps and the reflector of the instant invention may be conveniently used to light a scene during the making of a movie, for theatrical and TV productions, and the like.

BACKGROUND OF THE INVENTION

In the prior art, electrically powered lamps, for example, arc lamps, are commonly used to illuminate a movie scene, a theatrical set, a musical or television production, or the like. The lamp is typically mounted within an enclosure adjacent a reflecting mirror and arranged so as to cast light through a Fresnel lens mounted on the enclosure. The reflecting mirror and lamp arc movably mounted so as to permit the light cast by the lamp to either "flood" a scene or merely to cast a "spot" of light or something between these two extremes.

The lamp used in such applications is usually rated at several hundred or thousands watts and, in the prior art, only a portion of the light generated by the lamp is projected through the lens. A significant portion (up to two-thirds or even more) of the light is lost within the enclosure, causing the enclosure to heat significantly. This results not only in lost or wasted power, but also the excessive heating of the enclosure and its components. The lamp itself may be an arc lamp, quartz lamp, metal halide lamp or any other type of lamp.

BRIEF DESCRIPTION OF THE INVENTION

Briefly, and in general terms, the instant invention provides a lighting system comprising a housing with a lens or aperture mounted therein, a lamp or other bulb mounted within the enclosure and a reflecting mirror for projecting a portion of the light emitted by the lamp through the lens or aperture. The lamp and reflector move as one unit within the enclosure, the reflector being mounted on the opposite side of the bulb from the lens or aperture. A plurality of reflector segments are disposed in the enclosure between the movable reflector and the aperture or lens. The segments are disposed radially outwardly of the movable reflector and the lens or aperture. Each one of the segments may be conveniently defined by a portion of a con or of a cylinder. The reflector segments are mounted in a spaced array so as to reflect a significant portion of the light not reflected by the movable reflector towards the lens or aperture, but permitting the passage of air between the reflector segments to permit dissipation of heat from the lamp. The reflector segments are preferably mounted at such an angle so as to cause the proper respective flood or spot condition to the relevant position of the lamp/reflector assembly.

It has been determined that by utilizing a plurality of reflector segments, the amount of light transmitted through the lens can be increased by 33% or more.

BRIEF DESCRIPTION OF THE DRAWINGS

FIG. 1 is a front elevational view of a lamp assembly of the type employing the instant invention and which may be used to light a scene for the production of a movie, a theatrical play, or the like.

FIG. 2 is a diagrammical, sectional view through the lamp assembly of FIG. 1, but drawn to a larger scale to more clearly depict the internal structure of the lamp.

DETAILED DISCRIPTION

Figure 3:
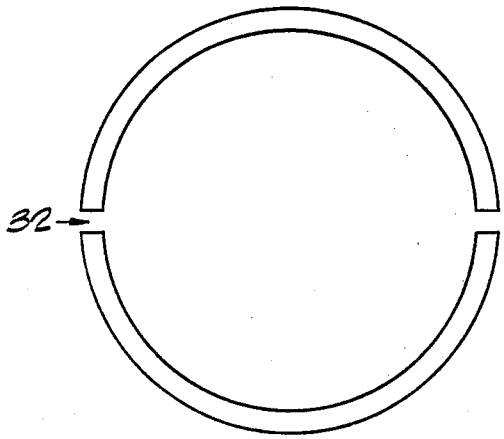
FIG. 3 is a front elevational view through one of the conical reflector segments shown in FIG. 2.

FIG. 1 is a front elevational view of a lamp of the type which may employ the instant invention and which may be used to light a scene for movie making, be used for theatrical productions, television productions, or musical productions or the like. The lamp assembly conventionally has a lamp 20, which may be an arc lamp, quartz lamp, metal halide lamp or other type of lamp mounted within a housing 10. Preferably, a Fresnel lens 11 is mounted on an axis 12 adjacent to the housing 10 which permits it to rotate to fill an aperture 13 in housing 10. Preferably, the rotatably mounted Fresnel lens 11 provides access to the lamp or bulb 20 and interacts with a safety switch 14 which de-energizes the lamp when the lens is rotated to the position shown in FIG. 1, that is, to a position permitting access to the bulb 20. When the lens 11 is rotated to its position filling aperture 1 (as shown in FIG. 2), switch 14 is closed permitting bulb 20 to be energized.

As can be more clearly seen in FIG. 2, a movable reflector 21 is provided on the opposite side of lamp 20 from lens 11. Incidentially lens 11 is shown in its closed position in FIG. 2. The reflector is usually a spherical reflector and the lamp is disposed at, or slightly above or below, the center of the sphere defined by the spherical reflector 21. The diameter of the perimeter of reflector 21 is determined by the geometry in its forwardmost (the "flood") position. Its diameter should be such that the angle subtended at the lamp 20 by the fresnel lens 11 equals the angle subtended at the lamp 20 in the backward direction by the reflector 21. This means that in the spot position part of this reflector 21 is not useful because it directs light to the interior wall of the enclosure 10 around lens 11.

Lamp 20 and reflector 21 are preferably mounted on a carriage arrangement 23, one side half of which can be seen in FIG. 2 and which comprises a support structure 24, a bearing block 25 and rail 26. Preferably, the spatial position of lamp 20 is fixed relative to reflector 21 by the support structure 24. Carriage 23 allows lamp 20 and reflector 21 assembly to be moved relative to lens 11, permitting the device to either cast a "flood" of light (reflector forward) or a "spot" of light (reflector back) or something therebetween. Conventionally, in the prior art, that portion of the light which did not either exit via lens 11 directly or after being reflected by reflector 21 was lost within enclosure 10, causing the enclosure and its components to rise in temperature. In accordance with the instant invention, however, a plurality of reflector segments 30A–30E which may be fixed within the enclosure by conventional means, are disposed generally radially outwardly of the reflector 21 and arranged at appropriate angles so as to reflect light rays from lamp 20 towards lens 11.

The individual segments 30A–30E may be disposed in a slightly overlapping fashion so as to not permit any appreciable amount of light to escape between the adjacent segments. The overlapping arrangement also provides air spaces permitting air currents 31 to better cool lamp 20. Five segments 30A–30E are shown in FIG. 2, but that number of segments depicted was selected for the ease of illustration and their positions relative to the reflector 21 and lamp 20 in FIG. 2 likewise for ease of illustration merely to convey the general idea. A preferred arrangement of reflectors 30A–30E will be described with reference to FIG. 5. More or fewer segments may be used as conditions dictate, but, generally speaking, as the number of segments increase, the air circulation improves, and the capablity of the segments to direct the light rays reflected therefrom to desired locations on the lens 11 also improves.

The segments are preferably defined by portions of a cone or cylinder and are preferably split into upper and lower halves to provide a clearance 32 in which support structure 24 may move when the carriage 23 is moved. While some loss of reflection efficiency is caused by the split, the loss is not particularly significant since lamp 20, when of the physical type depicted in FIGS. 1 and 2, does not direct much light towards the split.

The rear most reflector segment, segment 30A, may be arranged with an aperture at its distal end smaller than or equal to the perimeter diameter of mirror 21 provided that mirror 21 reaches it rearwardmost extent of movement on the carriage 23 before it contacts reflector segment 30A or alternatively provided that segment 30A is fixed to mirror 21.

The optical axis of movable reflector 21, lamp 20 and lens 11 is identified by numeral 27. The individual reflector segments 30A–30D are shown disposed at an angle to the optical axis to help reflect light towards lens 11. As will be seen, they can be alternatively disposed to reflect light to reflector 21. Reflector segments 30A–30D, define split segments of a cone. Reflector segment 30E, on the other hand, is shown with its reflecting surface parallel to the optical axis 27 and therefore is defined by a split segment of a cylinder. In any case, the interior surfaces of the segments 30A–30E preferably have a highly reflective surface for urging diverging light back along the optical axis 27. In cross section, any one of the segments 30A–30E depicted in FIG. 2 would define a split circle, as is shown in FIG. 3.

Figure 5:
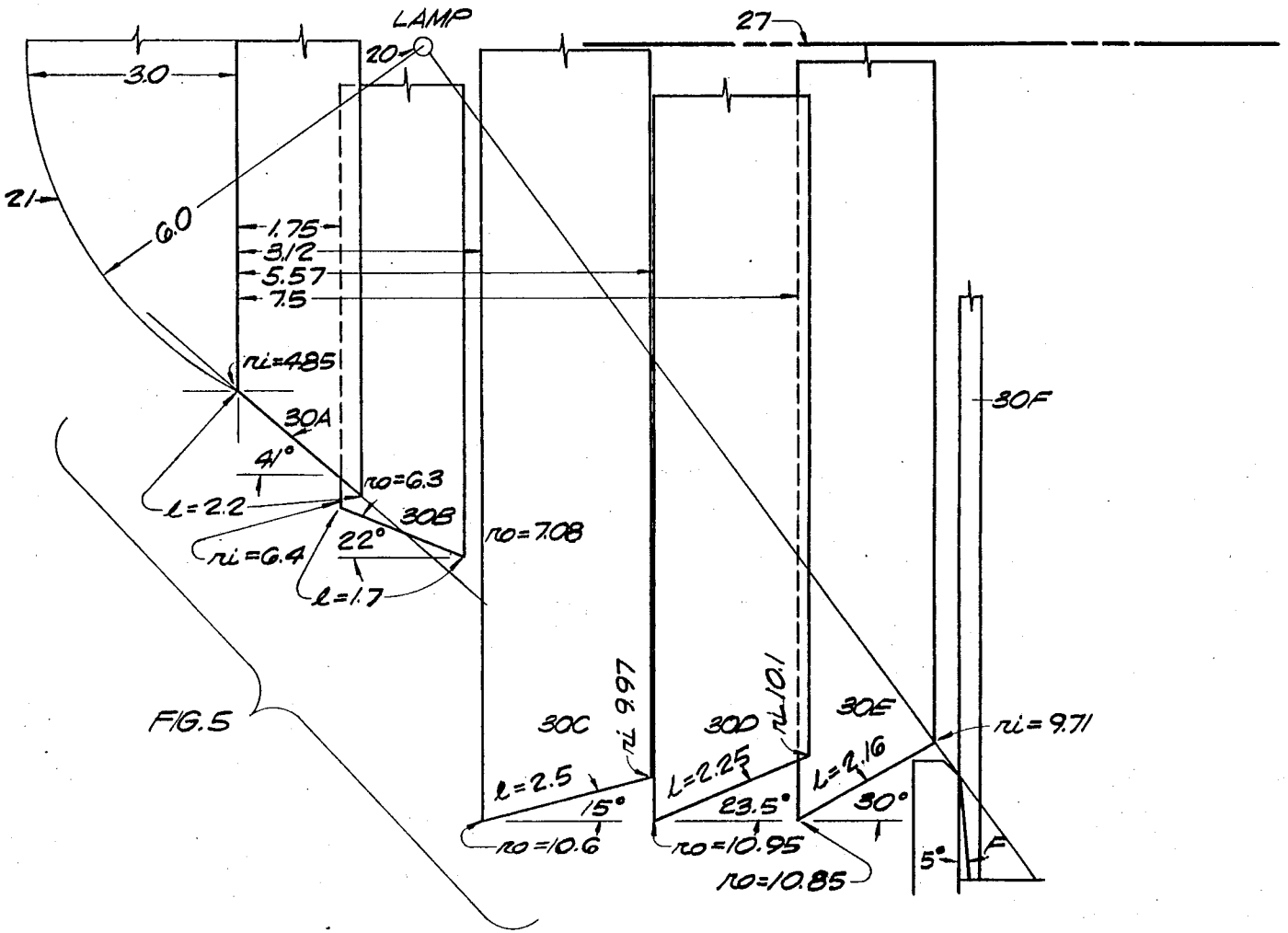
FIG. 5 is side elevational view of a preferred arrangement of the conical reflector segments.

Having described in general the configuration and different manners of arranging a lamp reflector comprising a series of segments defining a spaced array, now is an appropriate time to consider a specific and preferred embodiment of such an array. FIG. 5 and Table 1 define such an array in some detail. In this preferred embodiment, segments 30A and 30B are operationally fixed to reflector 21 and therefore move in concert with the reflector 21 and lamp 20 when the assembly is changed between its spot and flood configurations. Segments 30A–30E, on the other hand, are fixed within enclosure 10 and preferably are not moved along axis 27 when the lamp is changed from its spot to flood configuration and visa versa.

The sizes and shapes of reflector segments 30A–30E are defined in Table I. Thus, considering briefly reflector segment 30A, it preferably has an inside radius of 4.85 inches and an outside radius of 6.3 inches. Both radii are taken relative to the optical axis 27 of the lamp. The segment of the cone defined by segment 30A is disposed at a 41° angle to the optical axis and has a length of 2.2 inches. As can be seen from FIG. 5, segments 30A and 30B not only move with reflector 21 but also reflect light towards the fresnel lens 11. Segments 30C–30E, on the other hand, reflect light back toward reflector 21 and segments 30A and 30B, which in turn reflect the light reflected off of segments 30C–30E towards fresnel lens 11. Spherical reflector, in this embodiment, has a 6 inch radius and the focal length of the fresnel lens 11 is preferably 10.63 inches. The positions of the spherical reflector in FIG. 5 is for the assembly in its spot configuration. When in flood, the lamp 20 and associated reflectors 21, 30A and 30B are moved toward the fresnel lens 11 so that in this embodiment, the lamp 20 is about 4 inches away from same and the front edges of segments 30E and 30B are essentially the same distance from lens 11.

Figure 4:
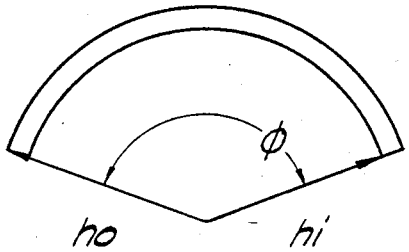
FIG. 4 is a plan view of the sectioned reflector of FIG. 3B, after cuts have been performed therein but before it has been folded to take a polygonal shaping cross section as shown in FIG. 3B.

Turning to Table I, it shows the inside radius ($r_i$), outside radius ($r_o$), length (l) and angle ($\theta$) which the segment takes with respect to the optical axis 27 of the fixture as well as the distance (d) from the periphery of the spherical reflector 21 to the rear edge of the segment reflector 30 when in its "spot" position. Additional data is provided which will now be described. Those skilled in the art will apreciate that it would be desirable to manufacture the segments 30A–30E out of a sheet of a material, such as polished aluminum, type C4 manufactured by Kinglux, which is fairly easily mechanically formed and which has good shock and high temperature characteristics. If appropriate forms are cut from a sheet of material, they can be bent around upon themselves to form the sections of a cone or cylinder. The data for forming reflector segments 30A–30E from a flat sheet of material is depicted Table I for the dimentions $h_i$, $h_o$ and $\phi$, which dimentions are defined with respect to FIG. 4 which shows a pattern for cutting the segments from a sheet of flat material. The segment would thereafter be bent to join their free ends to form the conical sections required. If necessary, the sections may be split as needed to define clearance 32 discussed with reference to FIG. 2.

TABLE I

| REFLECTOR | $r_i$ | $r_o$ | l | $\sin\theta$ | $\theta$ | $h_i$ | $h_o$ | $\phi$ | d |
|---|---|---|---|---|---|---|---|---|---|
| 30A | 4.85 | 6.3 | 2.2 | .656 | 41° | 7.393 | 9.604 | 236° | 0 |
| 30B | 6.4 | 7.08 | 1.7 | .375 | 22° | 17.067 | 18.88 | 135° | 1.75 |
| 30C | 9.97 | 10.6 | 2.5 | .259 | 15° | 38.494 | 40.927 | 93° | 3.12 |
| 30D | 10.1 | 10.95 | 2.25 | .399 | 23.5° | 25.31 | 27.444 | 144° | 5.57 |
| 30E | 9.77 | 10.85 | 2.16 | .5 | 30° | 19.54 | 21.17 | 180° | 7.5 |

TABLE I-continued

| REFLECTOR | $r_i$ | $r_o$ | l | $\sin\theta$ | $\theta$ | $h_i$ | $h_o$ | $\phi$ | d |
|---|---|---|---|---|---|---|---|---|---|
| | | | | (length dimensions are in inches) | | | | | |

EQUATIONS RELATING THESE VARIABLES:

$$\text{SIN}\theta = \frac{r_o - r_i}{l}$$

$$h_i = \frac{r_i}{\sin\theta}$$

$$h_o = \frac{r_o}{\sin\theta}$$

$$\phi = 360\frac{r_o}{h_o}$$

$$\sin\theta = \frac{r_i}{h_i}$$

The arrangement of reflector segments 30A–30E shown in FIG. 5 is an optimum arrangement for when movable relflector 21 is in its rearwardmost position so that the fixture to space a "spot" of light. As the movable mirror 21 is moved towards its forwardmost or "flood" position, the position of reflector segments 30C14 30E become less and less ideal. Certainly if the positions of reflector segments 30C–30E could be rotated as movable reflector 21 moves forwardly within the fixture, this would be preferable compared to having them fixed. It would likely require, however, the use of a camming mechanism interconnected with the carriage assembly 23 (FIG. 2) to rotate the positions of reflectors 30C–30E as movable reflector 21 moves forward within the fixture.

By using the additional reflector segments, the amount of light cast by the lamp through fresnel lens 11 can be increased by up to 33% and perhaps more. This is certainly a notable improvement. However, given the fact that one third or more of the light generated by lamp 20 is lost within the enclosure and the fact that the segments can increase the amount of transmitted light by around two thirds, those skilled in the art will appreciate that there is still room for additional improvement in effectively transmitting the light from the lamp 20 through the fresnel lens 11. In a normal fixture, the spherical reflector 21, lamp 20 and fresnel lens 11 are all centered axially with respect to the optical axis 27 of the device. Thus the return image from the spherical reflector 21 falls approximately in the same position as the arc itself within lamp 20. Unavoidably, the excited gas in the arc which emits the light is also capable of absorbing light of the same wavelength. Therefore, the returned image reflected by spherical reflector 21 is partially absorbed in the gas within lamp 20.

Figure 6D:
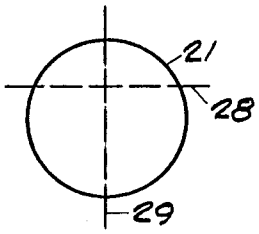
FIG. 6D is a front elevation view of a spherical reflector showing two part lines for dividing same.
Figure 6A:
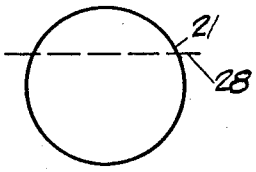
FIG. 6A is a front elevation view of a spherical reflector showing a part line for dividing same.

Because of the spherical geometry of the reflector 21, the reflecting light re-enters the lamp fairly efficiently, that is, at basicly a normal angle of incidence. If the spherical reflector is defined by two spherical sections, the reflecting light can be directed so as to miss lamp 20 entirely, forming reflected images immediately above and below the arc of the lamp. FIG. 6A is an front elevation view of a conventional spherical reflector 21. A pair of conventional spherical reflectors 21 are preferably parted at chord or part line 28 and the major portions thereof joined along their part lines 28 as depicited in elevational view 6B forming a double section reflector 221. The individual units 221A and 221B of reflector 221 are each defined by the major portion of a parted conventional reflector 21 as described with reference to FIG. 6A. Of course, instead of manufacturing relector 221 from two conventional reflectors 21, others may prefer to manufacture it as an integral unit.

Figure 6F:
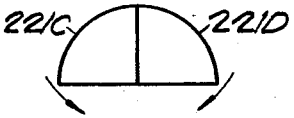
FIG. 6F is a plan view of the reflector of FIG. 6E.
Figure 6E:
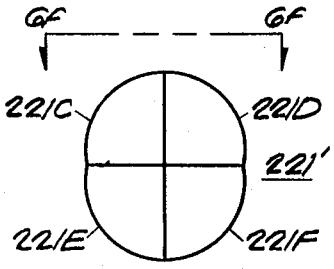
FIG. 6E is a front elevation view of a good section reflector.
Figure 6C:
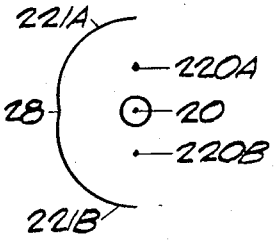
FIG. 6C is a side section view of the reflector of FIG. 6B.
Figure 6B:
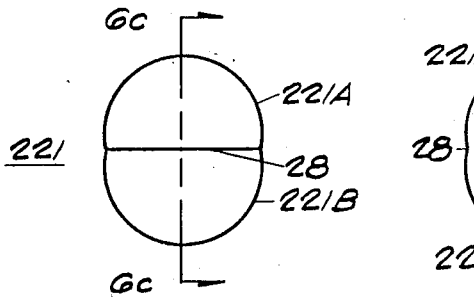
FIG. 6B is front elevation view of a double section reflector.

In FIG. 6C, the double sectioned reflector 221 of FIG. 6B is shown in a side sectional view. The two sections 221A and 221B are rotated slightly outwardly from each other so a to locate their focus points 220A and 220B immediately above and below the arc of lamp 20.

Additional advantages can be obtained by further splitting the reflector vertically and permitting the left hand and right hand portions to tilt inward thereby concentrating the "bright spots" at either end of the arc by centering the ends of the reflected image. In FIG. 6D another conventional spherical reflector 21 is shown with a first chord or part line 28 which is used for the same purpose as part line 28 described with reference to FIGS. 6A–6C. Those skilled in the art will appreciate that part line 28 defines a chord of the circle defined by spherical reflector 21. A second chord or part line 29 is also depicted in FIG. 6D which chord is arranged at right angles to chord or part line 28 and which passes through the center of the circle defined by the spherical reflector. The part lines define two larger segments and two smaller segments and the smaller segments can be discarded, assuming that they are created or manufactured in the first place. Two additional larger segments are similarly created and all four segments then arranged with their concave surfaces forward as depicted in the elevation view of FIG. 6E to form a quad section reflector 221. Again, the upper segments, segments 221C and 221D are rotated slightly outwardly compared to segments 221E and 221F as previously discussed with reference to FIG. 6C to move the points of focus immediately above and below lamp 20. As depicted in FIG. 6F, and as seggested by the arrows shown in that figure, segments 221C and 221E are rotated slightly towards segments 221D and 221F placing the hot spot, as seen by a quadrant, closer to the systems center. This is effective if the arc can be logically represented as two sources, radiating primarilly in opposite directions. For the typical 12 KV lamp used in the industry, this is believed to be a valid model of its light output.

Having described the invention in connection with specific embodiments thereof, modification may now suggest itself to those skilled in the art. Accordingly, the invention is not be limited to the aforegoing description, except as required by the appended claims.

What is claimed is:

1. A reflector assembly for projecting a beam of light along an optical axis, said assembly comprising:

(a) an enclosure having an aperture for projecting said beam of light;

(b) a source of light mounted within said enclosure;

(c) a reflecting mirror disposed within said enclosure, arranged to move axially with respect to the optical axis of the beam of light between positions adjacent said aperture and remote from said aperture, and disposed to reflect light source through said aperture; and (d) a plurality of reflector segments disposed between said movable reflector and the aperture in said enclosure, said segments each being defined as a portion of a cone or cylinder and with gaps therebetween arranged so as to permit the passage of air between such segments.

2. The reflector assembly of claim 1, wherein said segments are disposed at differing angles to the optical axis, said differing angles being selected such as to project the light emitted by the bulb either toward said aperture or toward said reflecting mirror.

3. Reflector assembly of claim 1, wherein a fresnel lens is disposed in said aperture.

4. The reflector assembly of claim 1 wherein said reflecting mirror is defined by upper and lower portions each of which defines a portion of a sphere, said portions being arranged with respect to each other to return images of the light source above an below said light source.

5. The reflector assembly of claim 4, wherein each said portion of said reflecting mirror comprises two parts of a spherical reflecting mirror, each part being canted toward said optical axis.

6. The reflector assembly of claim 1, wherein one group of said reflector segments is fixed relative to said reflecting mirror to move axially therewith and a second group of said reflector segments is fixed relative to the enclosure such as to remain fixed when the reflecting mirror and the first group of reflector segments is moved axially within the enclosure.

7. The reflector assembly of claim 6, wherein the first group of reflector segments reflects light toward said aperture and wherein the second group of reflector segments reflects light towards said reflecting mirror when said reflecting mirror is disposed remote from said aperture.

8. A reflecting mirror for reflecting a beam of light emitted from a light source along an optical axis, said mirror comprising at least two spherical sections for reflecting the light generally in the same direction along said optical axis, each said mirror being arranged to produce an image of the light source adjacent to but not coincident with the light source.

9. The mirror of claim 8, wherein the reflecting surface of each of said portions defines a portion of a sphere, which portion is defined by taking a first chord through a sphere dividing the sphere into two unequally size pieces, taking a second chord at right angles to the first cord through the smaller of the two pieces thereby dividing the smaller piece into still two more unequally size pieces, the portion of the mirror being defined by the larger of the last mentioned two pieces.

10. The reflecting mirror of claim 8 wherein said at least two spherical sections are joined along a line which intersects the optical axis of the reflecting mirror.

11. The reflecting mirror of claim 10, wherein a lamp provides the light source and is disposed on the optical axis of the mirror and forwardly of said line.

12. The reflecting mirror of claim 8, wherein the reflecting surface of each of said sections define a portion of a sphere, which portion is defined by taking a first chord through a sphere, dividing the sphere into two unequally sized pieces.

13. A reflecting mirror for reflecting a beam of light emitted from a light source along an optical axis, said mirror comprising at least two concave sections which confront each other and are disposed on the same side of said light source, each section being arranged to produce an image of the light source which is adjacent to but not coincident with the light source.

14. The reflecting mirror of claim 13, wherein the reflecting surface of each of said sections defines a portion of a sphere, which portion is obtained by taking a first cord through a sphere, dividing the sphere into two unequally sized pieces, taking a second cord at right angles to the first cord through a smaller of the two pieces thereby dividing the smaller piece into still two more unequally sized pieces, the section of the mirror being defined by the larger of the last two-mentioned pieces.

15. The reflecting mirror of claim 13, wherein said at least two sections are joined along a line which intersects the optical axis of the reflecting mirror.

16. The reflecting mirror of claim 15, wherein said light source is provided by a lamp which is disposed on the optical axis of the mirror and forwardly of said line.

17. The reflecting mirror of claim 13, wherein the reflecting surface of each of said sections defines a portion of a sphere.

18. The reflecting mirror of claim 17, wherein each portion is defined by taking a first cord through a sphere which divides the sphere into two unequally sized pieces.

* * * * *